US006167331A

United States Patent [19]

Matsumoto et al.

[11] Patent Number: 6,167,331

[45] Date of Patent: Dec. 26, 2000

[54] METHOD AND SYSTEM FOR CONTROLLING A PLURALITY OF VEHICLES AS A GROUP UNIT

[75] Inventors: Shinichi Matsumoto; Shinichi Higashi; Hiroshi Saeki; Yoshirou Nakagawa, all of Mihara, Japan

[73] Assignee: Mitsubishi Heavy Industries, Ltd., Tokyo, Japan

[21] Appl. No.: 09/136,402

[22] Filed: Aug. 19, 1998

[30] Foreign Application Priority Data

Aug. 21, 1997 [JP] Japan ..... 9-225099

[51] Int. Cl.[7] ..... G08G 1/00

[52] U.S. Cl. ..... 701/23; 318/587

[58] Field of Search ..... 701/23, 24, 25, 701/26, 96, 300, 301; 340/903, 435, 436; 342/455; 180/167–169; 318/587

[56] References Cited

U.S. PATENT DOCUMENTS

| | | | |
|---|---|---|---|
| 5,179,329 | 1/1993 | Nishikawa et al. | 701/24 |
| 5,267,173 | 11/1993 | Tanizawa et al. | 701/24 |
| 5,297,049 | 3/1994 | Gurmu et al. | 701/24 |
| 5,331,561 | 7/1994 | Barrett et al. | 701/96 |
| 5,369,591 | 11/1994 | Broxmeyer | 701/24 |
| 5,675,518 | 10/1997 | Kuroda et al. | 701/96 |
| 5,777,451 | 7/1998 | Kobayashi et al. | 701/23 |
| 5,928,294 | 7/1999 | Zelinkovsky | 701/24 |
| 5,936,517 | 8/1999 | Yeh | 701/301 |
| 5,999,874 | 12/1999 | Winner et al. | 701/96 |

FOREIGN PATENT DOCUMENTS

| | | |
|---|---|---|
| 0715286A1 | 6/1995 | European Pat. Off. . |
| 196 11 379 A1 | 4/1996 | Germany . |

*Primary Examiner*—Gary Chin

*Attorney, Agent, or Firm*—Birch, Stewart, Kolasch, & Birch, LLP

[57] ABSTRACT

A system and method for controlling a group of vehicles running on a road under vehicle-to-vehicle control where a joining group of vehicles (10) approaching from a branch road (7) is controlled by a system employing a moving target control method applied to only the head vehicle (1) in the joining group (10). Vehicle joining is achieved when a head moving target (21) in a continuous null (not-allocated) group (40) of moving targets on the main road that has an overall length larger than that of the joining vehicle group approaching from the branch road (7) and the head moving target of the null group (40) is synchronized with the head vehicle of the joining group (10).

8 Claims, 7 Drawing Sheets

METHOD AND SYSTEM FOR CONTROLLING A PLURALITY OF VEHICLES AS A GROUP UNIT

BACKGROUND OF THE INVENTION

The present invention relates to a method and system for automatically controlling, as a group unit, a plurality of vehicles running on a road.

The moving target method (hereinafter referred to as an MT method) is conventionally known as a method for automatically controlling running vehicles on a road.

A system using such an MT method comprises, as shown in FIG. 1, a group of position information equipment 73 for detecting the position and speed of running vehicles, a running control computer 75 for performing the management, control, etc., of the running vehicles on the basis of information on the position detected by the position information equipment 73, and a communication equipment 74 for conducting communication by providing information from the computer 75 to the running vehicle, transmitting a control instruction, and obtaining information from the running vehicle.

The MT method is a control method for, as shown in FIG. 2, setting an imaginary running path 800 on the running control computer 75 equivalent to an actual road (real road), setting a point (moving target hereinafter referred to as an MT) ideally running at a predetermined interval and speed on the imaginary running path 800, or at a vehicle-to-vehicle distance and running speed matching to the meteorological condition such as the falling of snow or frozen surface of a road, and enabling a real vehicle to run in a way to follow the MT. Since the conventional MT method maintains predetermined intervals between moving targets MT on the imaginary running path 800, regularly spaced intervals of moving targets MT are generated on the imaginary running path regardless of whether or not an actual vehicle 100 has entered the real road 76. Therefore, as shown in FIG. 2, the moving targets created in predetermined intervals or at a set vehicle-to-vehicle running distance, consist of two types of moving target, an MT (null MT) 720 not allocated to the running vehicle 100 and MT (allocated MT) 721 allocated to the running vehicle.

As in an example of FIG. 1, an MT (main road MT) 72 is generated on a main road 76 at a predetermined interval and speed and the MT72 is allocated to a vehicle 100 entering a vehicle control section 78. An MT72 (corres. to the MT720 in FIG. 2) not allocated to the vehicle is moved as a null MT72 on the main road 76. As illustrated in the accompanying drawings, null MTs are represented by hollow, circular symbols (i.e., 720, 72) and allocated MTs (i.e., 721, 711, matched with a vehicle) are represented by circles marked with an "X."

A joining MT71 corresponding to the MT72 on the main road 76 is generated on a branch road 77. When the MT71 is allocated to a respective vehicle (joining vehicle 101) entering from the branch road 77, the joining MT711 allocated to the joining vehicle is generated. Further, the null MT72 on the main road 76 corresponds to the joining MT711 allocated to the joining vehicle and is handled as the MT72 on the main road. As best seen in FIG. 2, the joining MT711 allocated to the joining vehicle is set in synchronism with the MT72 on the main road, so that vehicle joining is achieved at a joining point when the joining vehicle 101 synchronizes and becomes controlled by the MT72 on the main road. As best seen in FIG. 1, it is to be noted that the MT71, being not allocated to the vehicle, moves as the null MT71 (corres. to the MT720 in FIG. 2) on the branch road 77.

A second type of method for controlling running vehicles is a vehicle-to-vehicle control method. The vehicle-to-vehicle control method comprises setting a vehicle-to-vehicle detection sensor such as a radar for detecting a distance between individual vehicles and running a given vehicle in a way to keep a predetermined distance relative to a preceding vehicle on the basis of the vehicle-to-vehicle distance detected by the sensor. It is possible to control a plurality of vehicles as a group by combining a vehicle-to-vehicle communication with such vehicle-to-vehicle control.

In the conventional technique using the MT method, however, it is necessary to apply the MT to each vehicle. The interval between the MTs is generally set somewhat greater among various kinds of vehicles so as to provide ample safety even if there is a difference in vehicle length and in braking capability. At vehicle joining, there was some restriction in number of running vehicles per given interval length and hence some restriction in high density/high effective vehicle joining control.

Under the vehicle-to-vehicle control it is possible to increase the number of running vehicles per given section length in comparison with the MT method. For the application of the conventional MT method to the vehicle-to-vehicle control, however, it is necessary to constantly follow the MT so as to be matched to a corresponding vehicle under the vehicle-to-vehicle control. For this reason, the load of a computer necessary to calculate the position, speed, etc., of the MT cannot be ignored. Further, there was also the problem of how effectively the MT of a vehicle running on the main road should be controlled.

It is accordingly the object of the present invention to provide a method and system for controlling a running vehicle group, which enable a running vehicle from a branch road to be joined onto the main road in high density and a high efficient way.

BRIEF SUMMARY OF THE INVENTION

In order to solve the above-mentioned task, there is provided a running vehicle group controlling method for automatically controlling a plurality of vehicles running on a road which comprises the steps of:

allocating only a head vehicle of a joining vehicle group (a joining vehicle group controlled as a unit under vehicle-to-vehicle control for keeping a vehicle-to-vehicle distance constant) approaching from a branch road and joining onto a main road under vehicle-to-vehicle control, and joining on a main road, to a joining MT; and, when a length of a continuous null MT group on the main road is longer than that of the joining vehicle group, handling the head MT of the null MT group as a joining MT on the main road, setting the joining MT in synchronism with the joining MT on the main road and, by doing so, achieving vehicle joining on the main road.

Here, the control above is conducted by mounting a vehicle-to-vehicle detection sensor for detecting a vehicle-to-vehicle distance relative to a preceding vehicle to each of joining vehicle groups and effecting communication (road/vehicle communication) via communication equipment on the basis of the vehicle-to-vehicle distance detected by the vehicle-to-vehicle sensor as well as data (position/speed data of the running vehicle) from a communication (vehicle/vehicle communication) between the vehicles and/or position information equipment installed on the running roads.

Further, according to the present invention, when the length of a continuous null MT group on the main road is shorter than that of a joining vehicle group, the joining vehicle group is divided into a plurality of vehicle groups so as to make the length of the joining vehicle group smaller than that of the null MT group; a joining MT is allocated to a respective divided joining vehicle group; and a head MT of the null MT group is handled as an MT on the main road and the joining MT is sequentially set in synchronism with the MT on the main road and, by doing so, vehicle joining is achieved.

In the running vehicle group controlling method, an MT is generated on the main road at predetermined interval and moving speed and the MT is allocated to any vehicle approaching to a vehicle control section. The MT not allocated to the vehicle is handled as a null MT and a length is found on the continuous null MT group (null Mt group).

Since the vehicle group (joining vehicle group) joining from the branch road onto the main road is obeyed under vehicle-to-vehicle control for keeping the vehicle-to-vehicle distance constant, and the length (joining vehicle group length) of the joining vehicle group can be found as follows:

The length of the joining vehicle group N=

$$\sum_{n=1}^{N} An + B \times (N-1) \tag{1}$$

$$An+B\times(N-1) \tag{1}$$

where

An: the length of an N-th vehicle in the joining vehicle group;

B: the vehicle-to-vehicle length; and

N: the number of vehicles in the joining vehicle group.

Here, in the case where the length of the null MT group is greater than that of the joining vehicle group, a joining MT is allocated to only a head vehicle in the joining vehicle group. And the head MT in the null MT group is handled as an MT on the main road and the joining MT is set in synchronism with the MT on the main road and, by doing so, vehicle joining is achieved.

In the case where the length of the null MT group is shorter than that of the joining vehicle group, the joining vehicle group is divided into a plurality of new joining vehicle sub-groups so as to make the length of the joining vehicle group shorter than that of the null MT group. And the joining MT is allocated to only a head vehicle in the respective new vehicle group. In order to be matched to the respective joining MT allocated to the head vehicle, the new joining vehicle subgroup handles a head MT in the null MT group on the main road as an MT on the main road and sets it in synchronism with the MT on the main road and, by doing so, vehicle joining is achieved.

Additional objects and advantages of the invention will be set forth in the description which follows, and in part will be obvious from the description, or may be learned by practice of the invention. The object and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate a presently preferred embodiment of the invention and together with the general description given above and the detailed description of the preferred embodiment given below, serve to explain the principles of the invention.

DETAILED DESCRIPTION OF THE INVENTION

An embodiment of the present invention will be explained below with reference to the accompanying drawing.

Figure 1:
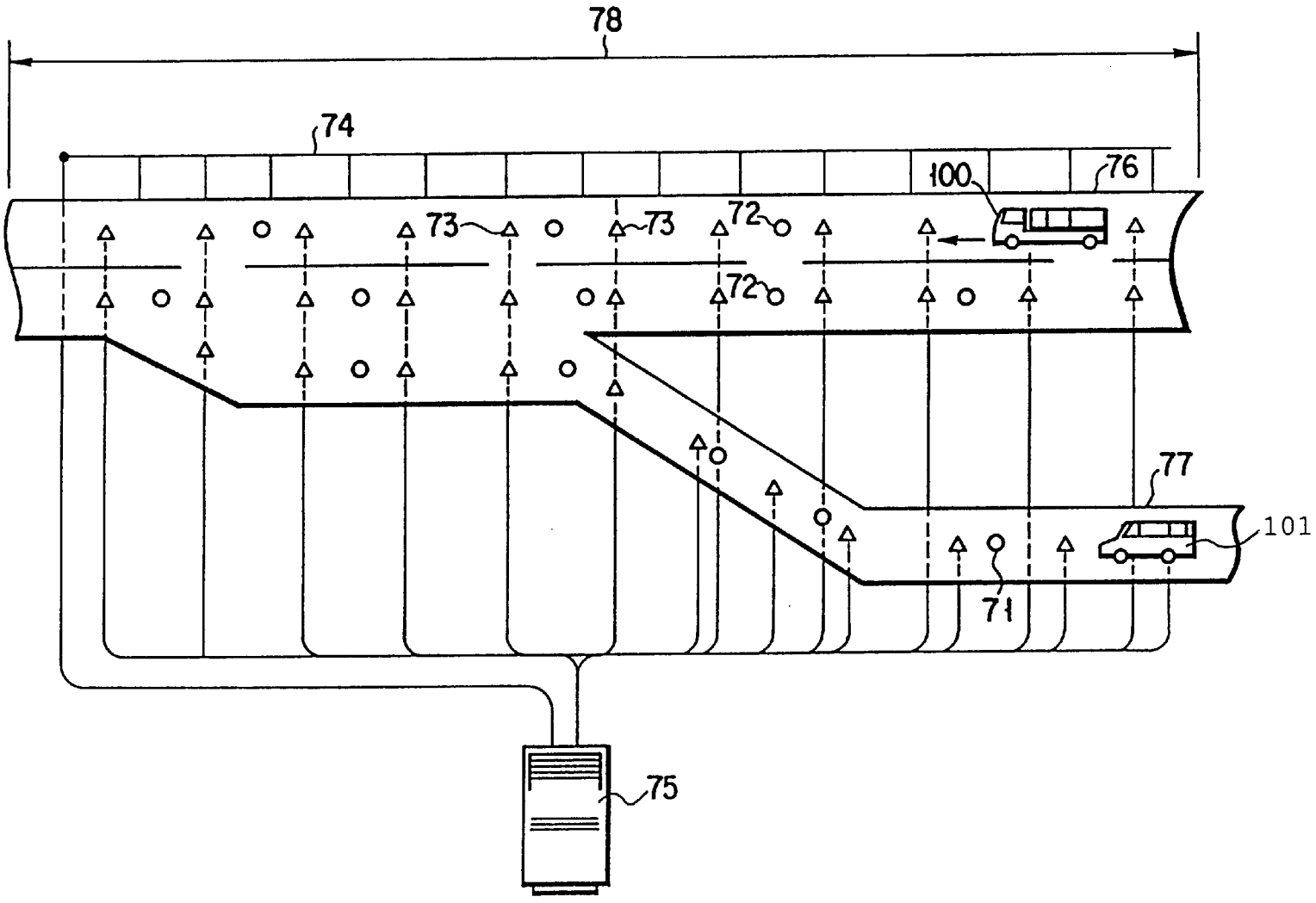
FIG. 1 (PRIOR ART)
FIG. 1 is a view showing an arrangement of a conventional system using an MT method.
Figure 2:
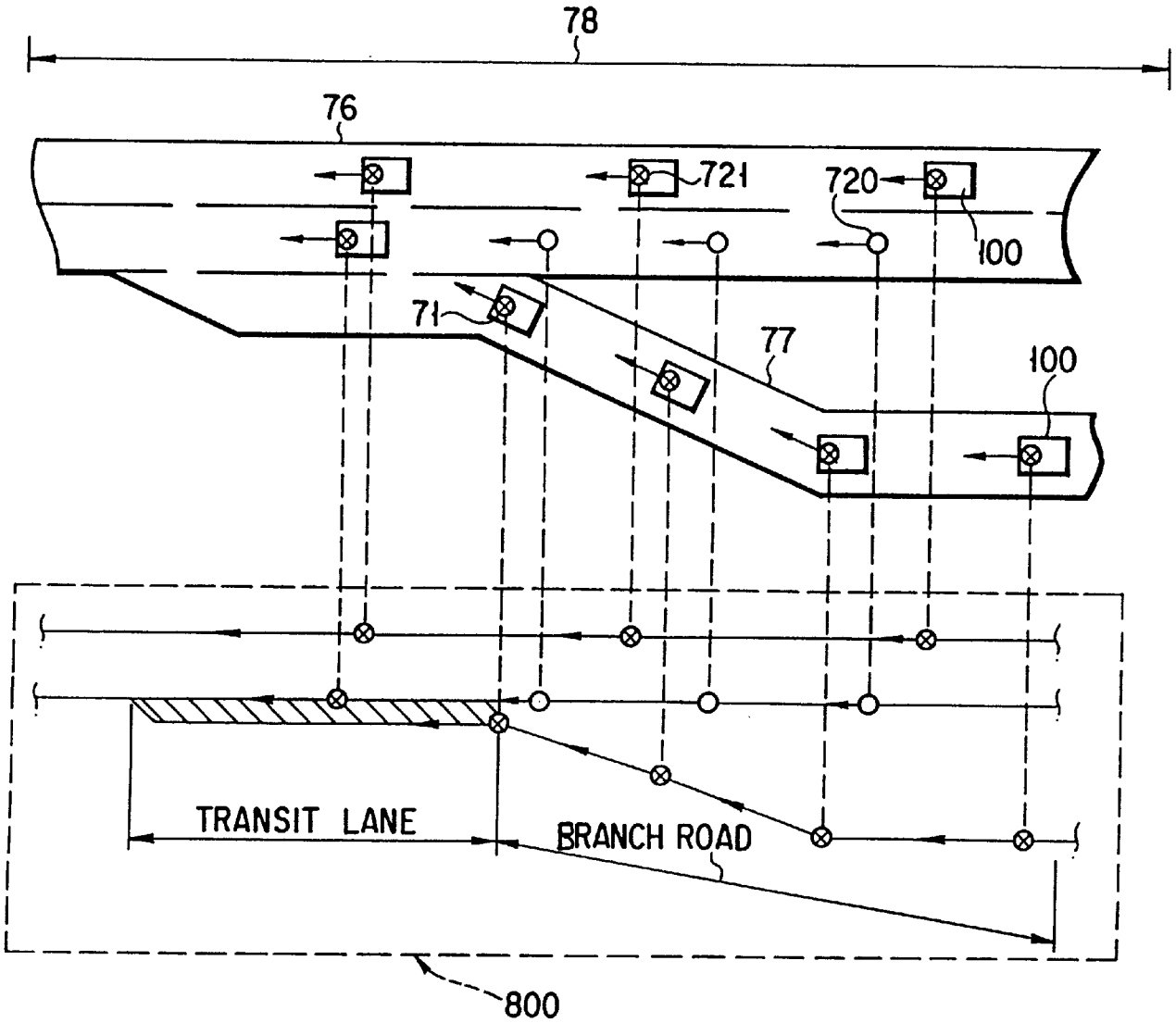
FIG. 2 (PRIOR ART)
FIG. 2 is a view for explaining the MT method.
Figure 3:
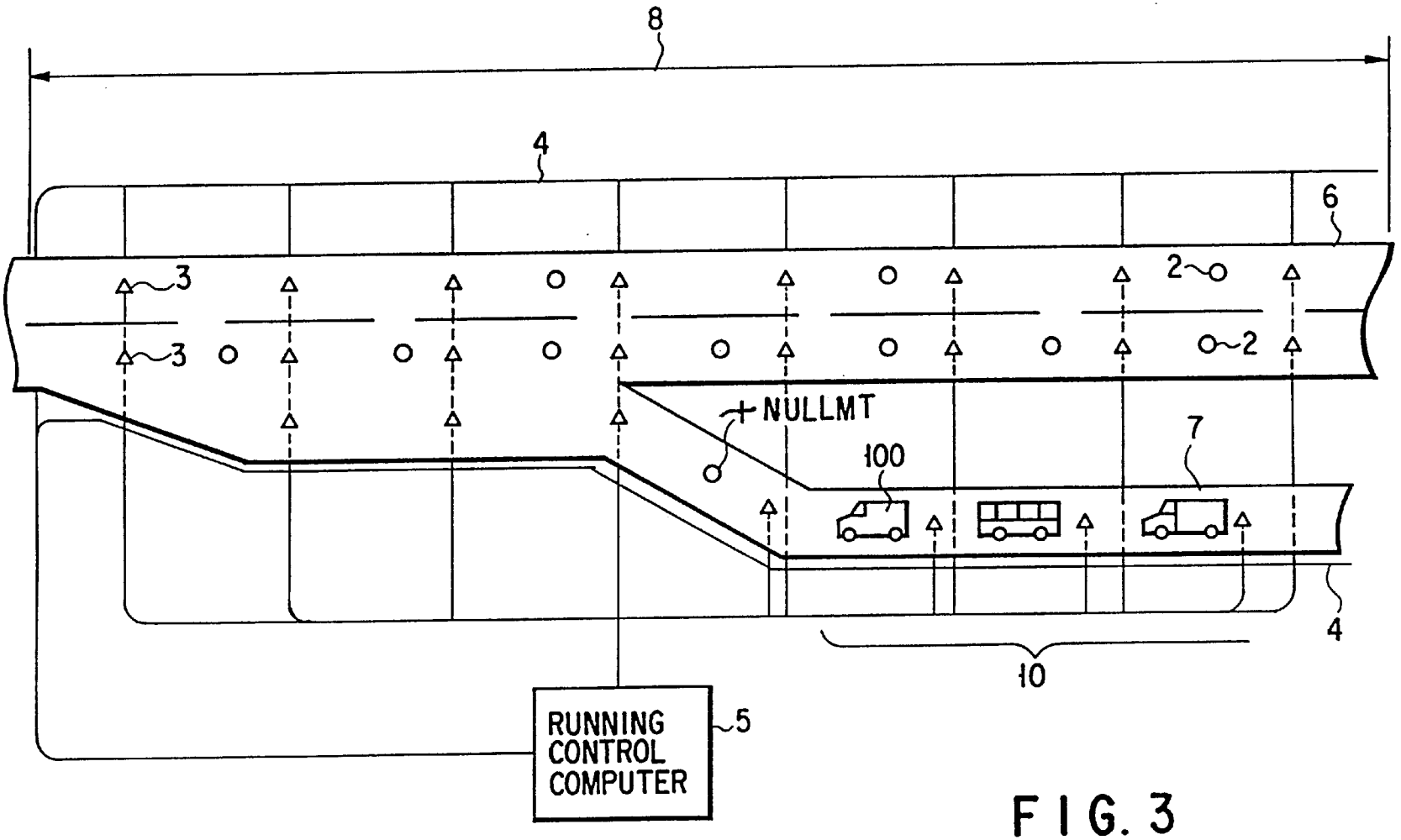
FIG. 3 is a view diagrammatically showing a running vehicle group controlling method according to one aspect of the present invention.

FIG. 3 is a diagrammatic view showing a system using a running vehicle group controlling method according to one aspect of the present invention. The present system uses an MT method and has an arrangement necessary to detect the positions of vehicles on roads (main road 6, branch road 7) and allocate an MT (MT2 on a main road, MT1 on a branch road) to an associated vehicle. That is, the present system relating to the MT method comprises a group of position information equipment 3 set on the running roads and detecting the position and speed of the running vehicles 100, a running control computer 5 for effecting the control, management, etc., of the running vehicles on the basis of information on the positions detected at the position information equipment 3, and a communication equipment 4 for providing information from the computer 5 to the running vehicles, transmitting control instructions and conducting communications for obtaining information from the running vehicles. It is to be noted that, for brevity in explanation, the "joining" aspect of the vehicle is explained in connection with FIG. 3 but that the same thing can also be said about a "branching aspect" of a vehicle.

Figure 4:
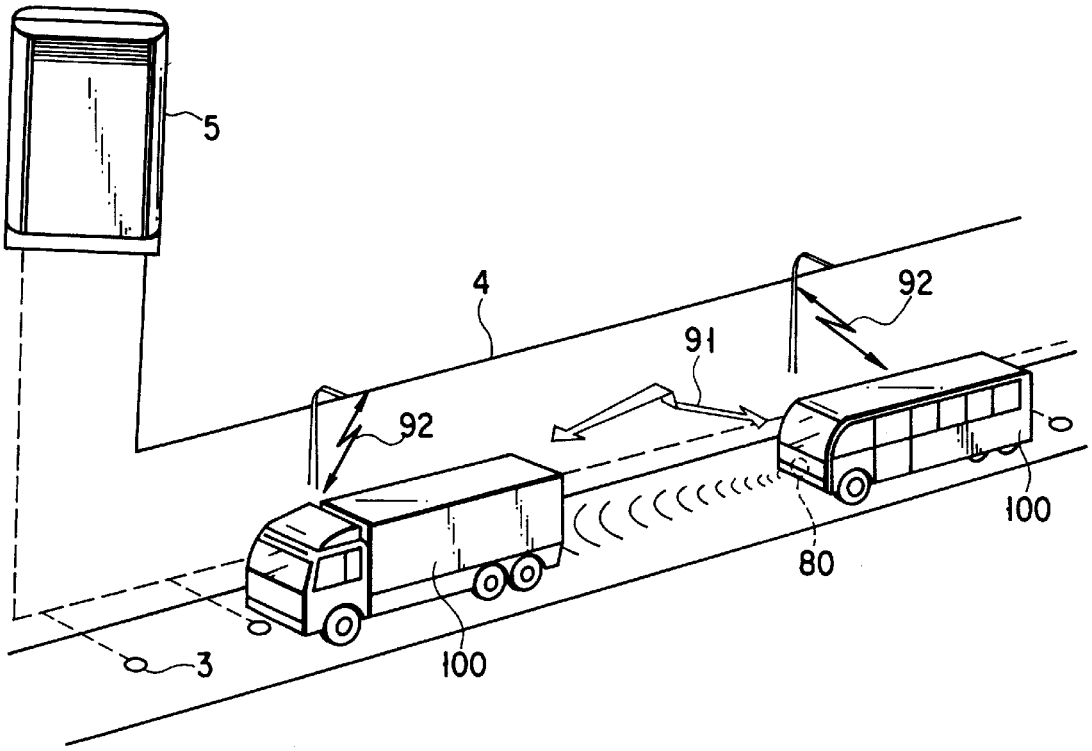
FIG. 4 is a view showing an arrangement of an on-road system for achieving vehicle-to-vehicle control using the system of FIG. 3.

FIG. 4 shows an arrangement of an on-road system for achieving vehicle-to-vehicle control with the use of the present system. Here the vehicle-to-vehicle control is done under which, with a vehicle-to-vehicle sensor 80 such as a radar mounted on the vehicle 100, the vehicle 100 can run in a way to be kept at a predetermined distance (vehicle-to-vehicle distance) relative to a preceding vehicle on the basis of the vehicle-to-vehicle distance detected by the sensor 80 and a group of vehicles can run as one unit in a way to be kept at such a predetermined distance. The vehicle-to-vehicle control is accomplished both with the use of the vehicle-to-vehicle distance detected by the sensor 80 and through the utilization of a communication (hereinafter referred to as a vehicle/vehicle communication) 91 between the vehicle and the adjacent vehicle or a communication (hereinafter referred to as a road/vehicle communication) 92 made on data items (data items on the position and speed of the running vehicle) from the position information equipment 3 via the communication equipment 4.

Figure 5:
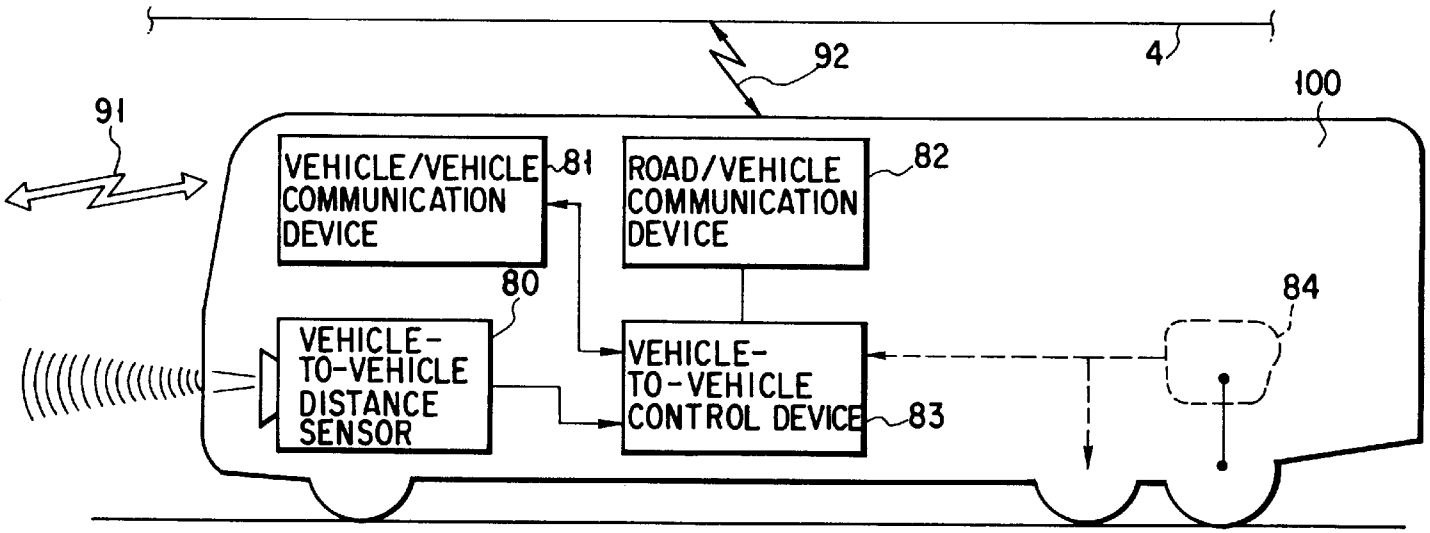
FIG. 5 is a view showing an on-vehicle system for realizing vehicle-to-vehicle control using the system.

FIG. 5 shows an arrangement of an on-vehicle system for realizing the vehicle-to-vehicle control. As shown in FIG. 5, the vehicle 100 has the vehicle-to-vehicle sensor 80 so as to detect the vehicle distance relative to the preceding vehicle and includes vehicle/vehicle communication device 81 for conducting the vehicle/vehicle communication 91, a road/vehicle communication device 82 for conducting a communication (road/vehicle communication) 92 between itself and the running control computer 5 via the communication equipment 4, and a vehicle-to-vehicle device 82. The vehicle-to-vehicle control device 83 is connected to the vehicle-to-vehicle detection sensor 80, vehicle-to-vehicle communication device 81 and road/vehicle communication device 82. And data items are passed between a drive device 84 and these associated devices.

Figure 6:
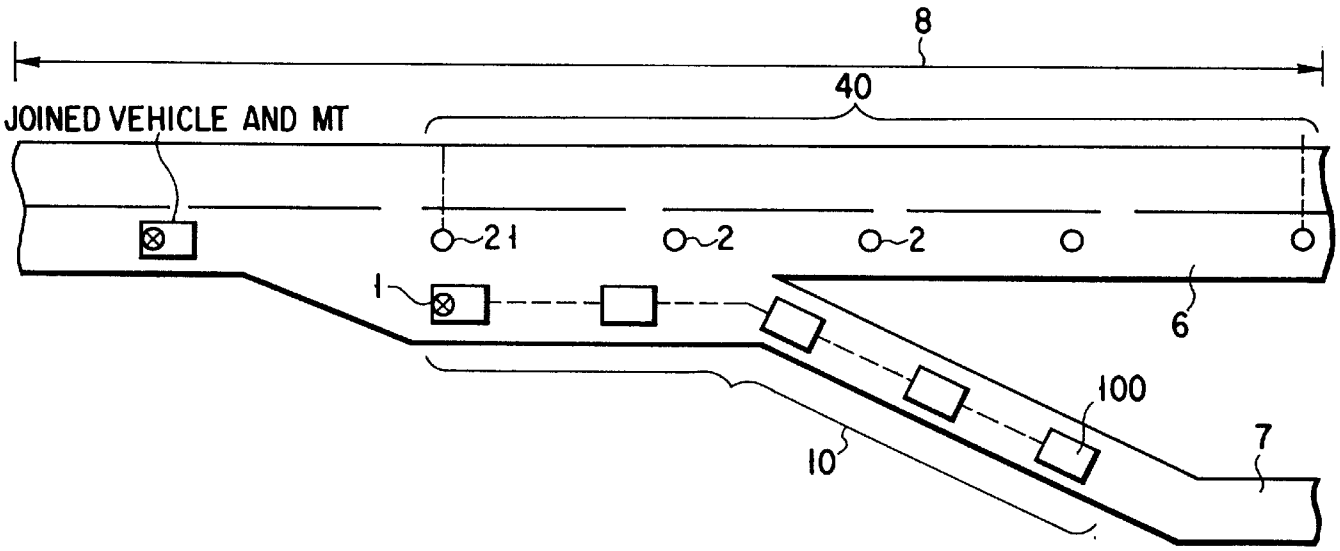
FIG. 6 is a view for explaining a running vehicle group controlling operation in the system above.

With reference to FIG. 6, an explanation will be given below about the control operation of the vehicle group in the system thus arranged.

First, an MT (MT on the main line) 2 is generated by the running control computer 6 on the main road (imaginary running line equivalent to the main road set on the running control computer in FIG. 3) at a predetermined interval and moving speed. When the vehicle 100 running on the main road 6 approaches to a given vehicle control section 8 set near a joining point between the main road 6 and the branch road 7, the running control computer 5 allocates the MT2 to the approaching vehicle. An MT2 not imparted to the vehicle moves as a null MT2 on the main road 6.

When, on the other hand, a group of vehicles 10 to be controlled under vehicle-to-vehicle control approaches to the branch road 7, the running control computer 5 allocates an MT (joining MT) 1 to only a head vehicle in the group of vehicles (joining vehicle group).

At this time, the running control computer 5 calculates a length of the joining vehicle group, 10, as follows:

The length of joining vehicle group=

$$\sum_{n=1}^{N} An + B \times (N-1) \tag{2}$$

$$An+B\times(N-1) \tag{2}$$

where

An: the length of an N-th vehicle in the joining vehicle group;

B: the vehicle-to-vehicle distance; and

N: the number of vehicles in the joining vehicle group.

In the case where the length of a group (group of null MTs) 40 of null MTs (MTs on the main road) continuously moving on the main road 6 is longer than the calculated length of the group of the joining vehicles, the running control computer 5 handles the head MT2 of the MT group 40 as an MT on the main road. The running control computer 5 allows the joining MT1 which is allocated to the head vehicle of the joining vehicle group 10 to synchronize with, and follow, a corresponding MT21. At this time, the respective vehicle in the joining vehicle group 10 is vehicle-to-vehicle controlled. Therefore, in spite of the joining MT1 being not allocated to other than the head vehicle of the joining vehicle group 10, it is possible to effect stable joining of the subsequent vehicle in the vehicle group.

In the running vehicle group controlling method, if the above-mentioned condition is not met, that is, if the length of the null MT group is shorter than that of the joining vehicle group, a wait is required until a null MT group satisfying the length of the joining vehicle group arrives. This leads to a time loss.

Figure 7:
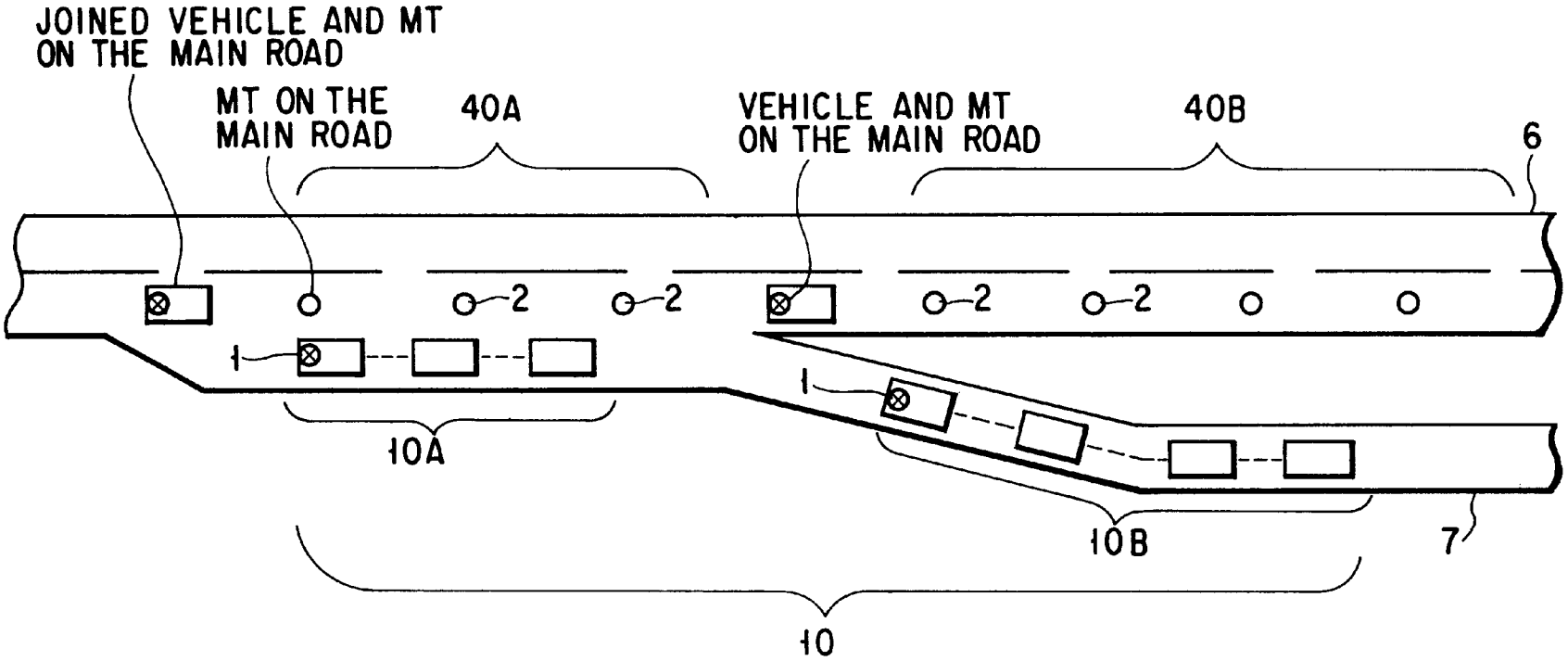
FIG. 7 is a view for explaining a running vehicle group controlling operation when the length of a null MT group is shorter than that of a joining vehicle group in the system.
Figure 8:
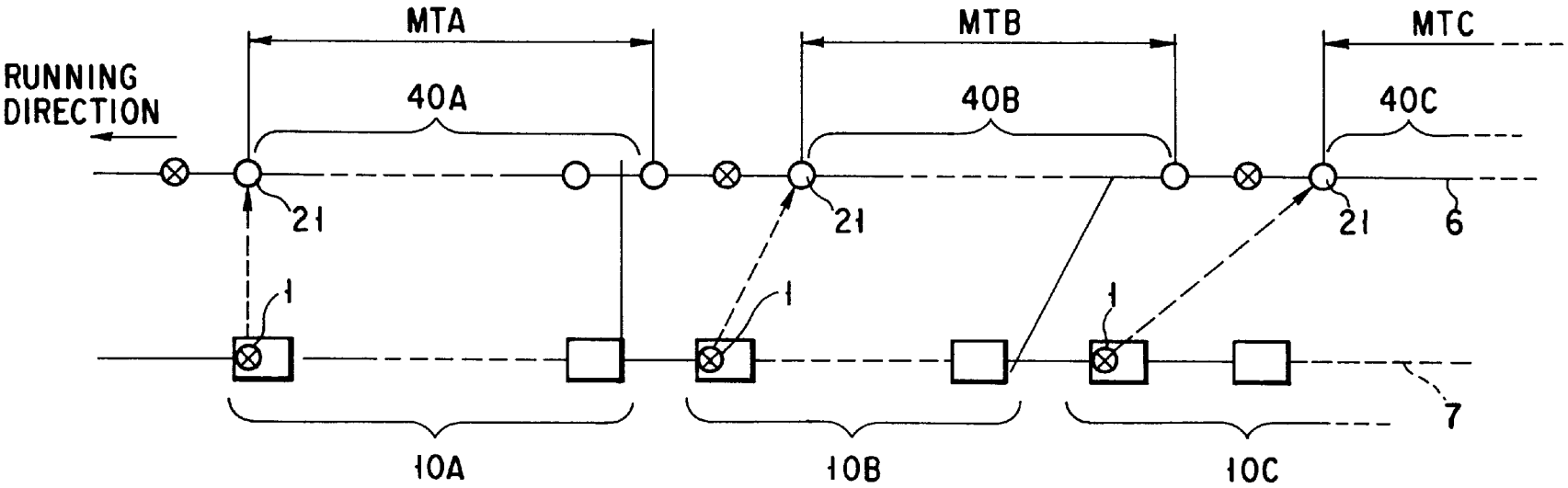
FIG. 8 is a model view for explaining, in more detail, the control operation of a running vehicle group in the example of FIG. 7.

With reference to FIGS. 7 and 8 an explanation will be given below about the running vehicle group control under which, even if the length of the null MT group is shorter than that of the joining vehicle group, it is not necessary to wait for a null MT group satisfying the length of the joining vehicle group.

First, the running control computer 5 in FIG. 3 finds the lengths of null MT groups 40A, 40B, . . . , that is, continuous null Mt2 groups divided by a corresponding vehicle (on the main road) as shown in FIG. 7. Further, the running control computer 5 divides the joining vehicle group 10 which approaches to the branch road 7 into a plurality of joining vehicle groups so as to make the length of the joining vehicle group shorter than that of the found null MT group. That is, the joining vehicle groups are reorganized. Here, it is assumed that, as shown in FIG. 8, the lengths MTA, MTB, MTC . . . of the null MT groups 40A, 40B, 40C, . . . are found and that the joining vehicle group 10 is divided into joining vehicle groups 10A, 10B, 10C . . . .

After such a division, the running control computer 5 allocates a joining MT1 to only a head vehicle in the respective joining vehicle sub-groups 10A, 10B, 10C . . . . First with respect to the joining vehicle group 10A, the running control computer 5 handles a head MT2 of the null MT group 40A as a corresponding MT21 on the main road and sets the joining MT1 of the joining vehicle sub-groups 10A in synchronism with a corresponding MT21 on the main road, so that vehicle joining is achieved. Also with respect to a subsequent joining vehicle sub-groups 10B, the running control computer 5 handles a head MT2 of a subsequent null MT group 40B as a corresponding MT21 on the main road and sets joining MT1 of the joining vehicle sub-groups 10B in synchronism with the corresponding MT21 to achieve vehicle joining. In the same procedure as will be set out above, safe joining is achieved for all joining vehicle groups divided.

According to the present invention as set out above in more detail, for the joining vehicle groups under highly densely operated vehicle-to-vehicle control, a joining MT is allocated only to the head vehicle and a head MT of a continuous null MT group greater in length than the joining vehicle group is handled as a corresponding MT on the main road and the joining MT is set in synchronism with the corresponding MT. By doing so it is possible to achieve simpler but high-efficient joining without allocating a joining MT to every vehicle and disturbing vehicle-to-vehicle control.

According to the present invention, in the case where any null MT group is not greater in length than the joining vehicle group, the length of a joining vehicle group is so divided as to be matched to that of the null MT group and, by doing so, the joining vehicle group is reorganized. It is, therefore, possible to achieve still higher-efficient vehicle joining without allocating a joining MT to every vehicle, disturbing the vehicle-to-vehicle control among the vehicle groups and involving any loss time for waiting for a null MT group greater in length than a joining vehicle group.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A running vehicle group controlling method for automatically controlling a plurality of vehicles shifting from a branch road to a main road, wherein said method operates on the basis of a moving target method wherein a plurality of vehicles running on an actual road are associated to a plurality of moving targets on a computer, the moving targets are allocated to an imaginary road on the computer which corresponds to the actual road, and wherein said moving targets are used to track and control the vehicles running on the actual road, said running vehicle group controlling method comprising the steps of:

detecting the vehicles that are shifting from the branch road to the main road as a joining vehicle group, wherein the joining vehicle group is operating under vehicle-to-vehicle distance control; and associating only a head vehicle of the joining vehicle group with only one of the moving targets created by the computer, and allocating the one moving target to the head vehicle of the joining vehicle group so that a space adjacent to the one moving target is created by the computer on the imaginary road, whereby said space has a length corresponding to at least a length of the joining vehicle group, and whereby none of the non-associated moving targets are assigned to any of the vehicles in the detected vehicles.

2. The method according to claim 1, comprising the additional steps of dividing the joining vehicle group into at least two subgroups, when the length of the space adjacent to the one moving target is smaller than the length of the joining vehicle group, so that the vehicles constituting one of the subgroups are able to be allocated with the one moving target and join within the space adjacent to the one moving target; and detecting the vehicles of one of the other subgroups as new joining vehicle group for shifting to the main road from the branch road.

3. A running vehicle group controlling method for automatically controlling a plurality of vehicles running on a road, comprising the steps of:

allocating a moving target for joining to only a head vehicle in a joining vehicle group, wherein the joining vehicle group comprises a group of approaching vehicles joining a main road from a branch road, when the vehicles in the joining vehicle group are controlled as a unit under vehicle-to-vehicle control in order to maintain a constant vehicle-to-vehicle distance; and determining a length of the joining vehicle group approaching the main road from the branch road; and determining a length of a continuous, non-allocated group of moving targets on the main road; and setting a head moving target of a continuous, non-allocated group of moving targets on the main road in synchronism with the moving target for joining, when the length of the continuous, non-allocated group of moving targets on the main road is longer than the length of the joining vehicle group, in order to achieve joining of the joining vehicle group with the continuous moving target group on the main road.

4. The method according to claim 3, comprising the additional step of dividing the joining vehicle group into a plurality of smaller sub-groups when the length of the joining vehicle group is longer than the length of the continuous, non-allocated group of moving targets on the main road, in order to make the length of any moving target for joining shorter in length than the continuous moving target group on the main road.

5. A running vehicle group controlling system for automatically controlling a plurality of vehicles shifting from a branch road to a main road, wherein said system operates on the basis of a moving target method wherein a plurality of vehicles running on an actual road are associated to a plurality of moving targets on a computer, the moving targets are allocated to an imaginary road on the computer which corresponds to the actual road, and wherein said moving targets are used to track and control the vehicles running on the actual road, said running vehicle group controlling system comprising:

a detecting unit for detecting the vehicles that are shifting from the branch road to the main road as a joining vehicle group, wherein the joining vehicle group is operating under vehicle-to-vehicle distance control; and an associating unit for associating only a head vehicle of the joining vehicle group with only one of the moving targets created by the computer, wherein said associating unit allocates the one moving target to the head vehicle of the joining vehicle group so that a space adjacent to the one moving target is created by the computer on the imaginary road, whereby said space has a length corresponding to at least a length of the joining vehicle group, and whereby none of the non-associated moving targets are assigned to any of the vehicles in the detected vehicles.

6. The system according to claim 5, comprising a dividing unit for dividing the joining vehicle group into at least two subgroups, when the length of the space adjacent to the one moving target is smaller than the length of the joining vehicle group, so that the vehicles constituting one of the subgroups are able to be allocated with the one moving target and join within the space adjacent to the one moving target; wherein said detecting unit detects the vehicles of one of the other subgroups as new joining vehicle group for shifting to the main road from the branch road.

7. The system according to claim 5, further comprising an on-road system and an on-vehicle system, wherein the on-road system comprises:

a position information equipment group for detecting a position and speed of each of the running vehicles as vehicle position information;

a running control computer, including the detecting unit and the associating unit, for performing management and control of each of said running vehicles based on the vehicle position information detected by the position information equipment group; and a communication equipment for performing communication for effecting the transfer of the vehicle position information between the running control computer and said running vehicles and for transmission of a control instruction.

8. The system according to claim 7, wherein the on-vehicle system comprises:

a vehicle-to-vehicle distance detection sensor for detecting a vehicle-to-vehicle distance with respect to a preceding vehicle;

a vehicle/vehicle communication device for performing vehicle/vehicle communication;

a road/vehicle communication device for performing road/vehicle communication with the running control computer via the communication equipment; and a vehicle-to-vehicle distance control device, connected to the vehicle-to vehicle distance detection sensor, the vehicle/vehicle communication device, the road/vehicle communication device and a vehicle drive device, for controlling the vehicle-to-vehicle distance with respect to the preceding vehicle.

* * * * *